US011767952B1

(12) United States Patent
Yang

(10) Patent No.: US 11,767,952 B1
(45) Date of Patent: Sep. 26, 2023

(54) MULTI-WIRE LED RUBBER-COVERED STRING LIGHT AND PROCESSING METHOD THEREOF

(71) Applicant: Chengzhuo Yang, Taizhou (CN)

(72) Inventor: Chengzhuo Yang, Taizhou (CN)

(73) Assignee: Chengzhuo Yang, Taizhou (CN)

( * ) Notice: Subject to any disclaimer, the term of this patent is extended or adjusted under 35 U.S.C. 154(b) by 0 days.

(21) Appl. No.: 17/989,413

(22) Filed: Nov. 17, 2022

(51) Int. Cl.
*F21S 4/10* (2016.01)
*F21V 23/00* (2015.01)
*F21Y 115/10* (2016.01)

(52) U.S. Cl.
CPC ..... *F21S 4/10* (2016.01); *F21V 23/001* (2013.01); *F21Y 2115/10* (2016.08)

(58) Field of Classification Search
CPC ..... F21S 4/10; F21V 23/001; F21Y 2115/10; F21K 9/00
See application file for complete search history.

(56) References Cited

U.S. PATENT DOCUMENTS 11,603,983 B2 * 3/2023 Shan ..... F21V 23/001

FOREIGN PATENT DOCUMENTS

| | | | |
|---|---|---|---|
| CN | 207975515 | * 10/2018 | ..... F21Y 2115/10 |
| CN | 216591187 U | 5/2022 | |
| CN | 216619427 U | 5/2022 | |
| CN | 216779266 U | 6/2022 | |

OTHER PUBLICATIONS

CN 207975515, Oct. 16, 2018, Author—Liu, English translation (Year: 2018).*

* cited by examiner

*Primary Examiner* — Peggy A Neils
(74) *Attorney, Agent, or Firm* — Nitin Kaushik

(57) ABSTRACT

The present disclosure discloses a multi-wire LED rubber-covered string light and a processing method thereof, and is applicable to the technical field of manufacturing and processing of colored lights. The dispensing bonding strength is high, wires are free of relative movement and have high stability, and practicality is high. According to the technical solution, insulation layers are removed in an axial direction of the wires at fixed length intervals to form a plurality of solder joints, the solder joints of the wires are in one-to-one correspondence and form bead soldering areas, patch LED beads are disposed in the bead soldering areas, the patch LED beads are fixed by dispensing after being connected to the bead soldering areas, and beads are formed by connecting the patch LED beads with the bead soldering areas.

9 Claims, 2 Drawing Sheets

MULTI-WIRE LED RUBBER-COVERED STRING LIGHT AND PROCESSING METHOD THEREOF

FIELD OF TECHNOLOGY

The present disclosure relates to the technical field of manufacturing and processing of colored lights, and more particularly, relates to a multi-wire LED rubber-covered string light and a processing method thereof.

BACKGROUND

A multi-wire LED rubber-covered string light is a kind of decorative lighting including light-emitting beads and wires, and is widely used in decoration, architecture, landscape and other industries. The multi-wire LED rubber-covered string light is pursued by people as being energy-saving, environmentally friendly, beautiful and inexpensive.

An existing multi-wire LED rubber-covered string light is generally formed by two wires disposed side by side, a plurality of patch LEDs mounted on the two wires at certain intervals in a length direction of the wires, and sealing glue for sealing the patch LEDs inside the light. When the traditional string light is subjected to external forces, as the string light is mainly sealed by dispensing and the wires are mainly fixed by dispensing, the two wires are prone to relative movement, and thus the LEDs on the wires are prone to falling off. The overall connection strength is not high, subsequent use may be affected, and the practicality is poor.

SUMMARY

In view of the defects in the prior art, the present disclosure aims to provide a multi-wire LED rubber-covered string light. The dispensing bonding strength is high, wires are free of relative movement and have high stability, and practicality is high.

In order to achieve the above purpose, the present disclosure provides the following technical solution: a multi-wire LED rubber-covered string light includes a plurality of wires, the wires are disposed side by side, each of the wires includes a wire core and an insulating layer wrapping the wire core, the insulation layers are removed in the axial direction of the wires at fixed length intervals to form a plurality of solder joints, the solder joints of the wires are in one-to-one correspondence and form bead soldering areas, patch LED beads are disposed in the bead soldering areas, the patch LED beads are connected to the bead soldering areas in parallel, or in series, or in series and parallel, the patch LED beads are fixed by dispensing after being connected to the bead soldering areas, and beads are formed by connecting the patch LED beads with the bead soldering areas.

The present disclosure is further set as: the bead soldering areas further include dispensing seats disposed on the solder joints, each of the dispensing seats includes a base, wire fixing slots provided in the base, and wrapping seats disposed on two axial sides of the base, the wire fixing slots match the solder joints, and the wrapping seats match the insulating layer.

The present disclosure is further set as: an inner wall on one axial side of the wire fixing slot is provided with an inner tip structure, an inner wall on the other axial side of the wire fixing slot is set as an arc structure, and endpoints of two axial sides of the arc structure form two outer tip structures on the inner wall on the other side of the wire fixing slot.

The present disclosure is further set as: the arc structure is a concave arc.

The present disclosure is further set as: the base is made of conductive material, the wrapping seats are made of insulating material, the base forms a totally wrapping structure with the patch LED beads by dispensing, and the wrapping seats are exposed outside a dispensing area.

The present disclosure is further set as: spiral positioning structures are further disposed on the two axial sides of the base, the spiral positioning structures include extension grooves that are disposed on the base and are perpendicular to the base, and spiral grooves provided in inner walls of the extension grooves, and exposed parts of the wires are embedded in the spiral grooves after passing through the two outer tip structures of the inner wall on the other side of the wire fixing slot.

The present disclosure is further set as: an embedding depth of the exposed parts of the wires in the spiral grooves is P, a diameter of the exposed parts of the wires is R, and a ratio of P to R is 0.5-2.

The present disclosure is further set as: the wrapping seat includes a seat body, wrapping walls disposed at opposite positions on two radial sides of the seat body, and guide-in blocks disposed on the wrapping walls, and forms a groove structure, sections of the guide-in blocks are in an arc shape, and an arc height of the guide-in blocks is increased gradually in a direction from a groove opening to a groove bottom.

The present disclosure is further set as: a ratio of a thickness of ends, close to the groove bottom, of the guide-in blocks to a thickness of ends, close to the groove opening, of the guide-in blocks is 0.5-2.

The above technical solution has the following beneficial effects: 1. The insulation layers are removed in the axial direction of the wires at fixed length intervals to form the plurality of solder joints, the solder joints of the wires are in one-to-one correspondence and form the bead soldering areas, the patch LED beads are disposed in the bead soldering areas, the patch LED beads are connected to the bead soldering areas in parallel, or in series, or in series and parallel, the patch LED beads are fixed by dispensing after being connected to the bead soldering areas, and the beads are formed by connecting the patch LED beads with the bead soldering areas. In this way, the insulating layers of the wires are removed, the solder joints of the wires are in one-to-one correspondence to form the soldering areas, the beads are wrapped by dispensing after being soldered, the dispensing seats are provided to enhance axial multi-point fixation of the wires and reduce axial movement of the wires, and thus the overall dispensing firmness is improved.

2. Further, due to the facts that each of the dispensing seats includes the base, the wire fixing slots provided in the base, and the wrapping seats disposed on the two axial sides of the base, the wire fixing slots match the solder joints, and the wrapping seats match the insulating layer, an effect of dual fixation for non-exposed parts of the wires and the exposed parts of the wires is achieved, the stability is high, double guarantee for tensile stability after dispensing for fixing is achieved, the structure is simple, and practicability is high.
3. Further, due to the facts that the inner wall on one axial side of each wire fixing slot is provided with the inner tip structure, the inner wall on the other axial side of the wire fixing slot is set as the arc structure, and the endpoints of the two axial sides of the arc structure form the two outer tip structures on the inner wall on the other side of the wire fixing slot, fitting of the wires can be achieved through the arc structures, increasing the contact area between the wires and the wire fixing slots; and the inner tip structures and the outer tip structures form a triangular fixing effect, such that the tensile effect of the wires in the wire fixing slots is improved, the overall stability is greatly improved, the practicability is high, and the structure is simple.

4. Finally, due to the facts that the spiral positioning structures are further disposed on the two axial sides of the base, the spiral positioning structures include the extension grooves that are disposed on the base and are perpendicular to the base, and the spiral grooves provided in the inner walls of the extension grooves, and the exposed parts of the wires are embedded in the spiral grooves after passing through the two outer tip structures of the inner wall on the other side of the wire fixing slot, the contact area between the parts of the wires and the spiral grooves is greatly increased by embedding the parts of the wires along the spiral grooves, good structural stability is formed, the practicability is high, and the structure is simple.

A processing method applicable to the above multi-wire LED rubber-covered string light includes the following steps: S1, a preparation stage: preparing wires, a wire stripping machine, beads, a soldering machine, dispensing seats, and a dispensing machine;

S2, a stripping stage: stripping the wires at a fixed length through the wire stripping machine;

S3, an installation stage: installing the stripped wires to the dispensing seats, exposed parts of the wires forming a triangular fixed structure in wire fixing slots;

S4, a spiral fixing stage: embedding parts, not fixed in the wire fixing slots, of the wires into spiral grooves to form spiral positioning;

S5, a dispensing stage: performing dispensing on the wire fixing slots and the spiral grooves through the dispensing machine, and performing temperature control, so as to form dispensing wrapping, dispensing wrapping specifically including the following steps:

S50, heating metal parts of the dispensing seats, a heating temperature being 70-80° C.; and

S51, supplying a gas mixture to a dispensing area, the gas mixture being a mixture of nitrogen and oxygen, and containing 10-30% of oxygen by volume, a flow rate K (V/min) of the gas mixture satisfying $30-P \leq K < 40$ in the case that oxygen concentration in the gas mixture is specified as P (% by volume), $P \geq 10$; and

S6, a re-fixing stage: fixing parts, on one sides of insulating layers, of the wires onto wrapping seats after the completion of dispensing, so as to complete processing.

The above technical solution has the following beneficial effects: in the method, by adding the process of heating the dispensing seats in the dispensing process, the fluidity of glue is improved by preheating, the wrapping effect of the glue is ensured, the practicability is high, and the structure is simple; and by supplying the gas mixture which includes inert gas and oxygen, the dispensing environment can conform to the fluidity of the glue, the fully wrapping effect of the glue is achieved, the overall tensile effect is improved accordingly, the practicability is high, and the structure is simple.

Figure 1:
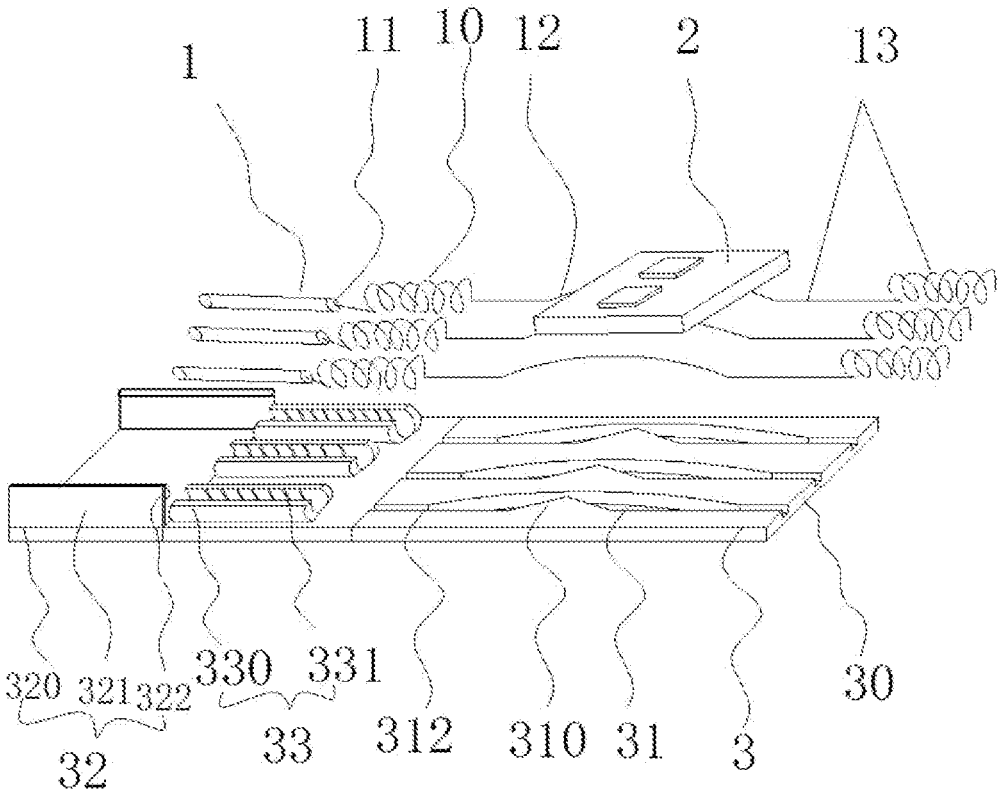
FIG. 1 is a schematic structural diagram of a dispensing seat and wires of a multi-wire LED rubber-covered string light and a processing method thereof according to embodiments of the present disclosure.

Reference numerals in the figures, 1—Wire; 10—Wire core; 11—Insulating layer; 12—Solder joint; 13—Bead soldering area; 2—Patch LED bead; 3—Dispensing seat; 30—Base; 31—Wire fixing slot; 32—Wrapping seat; 320—Seat body; 321—Wrapping wall; 322—Guide-in block; 310—Inner tip structure: 311—Arc structure; 312—Outer tip structure: 33—Spiral positioning structure; 330—Extension groove; and 331—Spiral groove.

DESCRIPTION OF THE EMBODIMENTS

Figure 2:
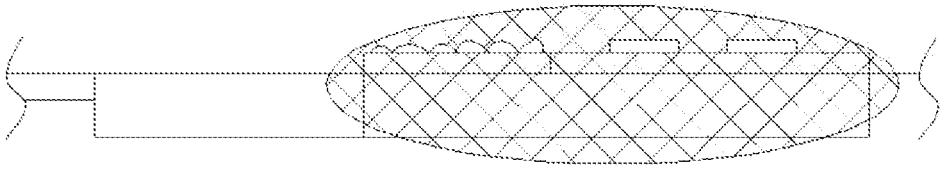
FIG. 2 is a schematic structural diagram of a multi-wire LED rubber-covered string light after dispensing and a processing method thereof according to embodiments of the present disclosure.

Referring to FIG. 1 and FIG. 2, a multi-wire LED rubber-covered string light and a processing method thereof according to embodiments of the present disclosure are further illustrated.

For ease of illustration, spatially relative terms such as "above", "below", "left", and "right" are used in the embodiments to illustrate the relationship of one element or feature relative to another element or feature illustrated in the figures. It should be understood that the spatial terms are intended to include different orientations of devices in use or operation, in addition to the orientation shown in the figures. For example, if a device in the figure is inverted, an element described as being "below" the other element or feature may be positioned "above" the other element or feature. Thus, the exemplary term "below" may include both above and below orientations. A device may be positioned in other manners (being rotated by 90 degrees or in other orientations), and spatially relative descriptions used herein may be interpreted accordingly.

Moreover, relational terms such as "first" and "second" are used only to distinguish one component from another with the same name, and do not necessarily require or imply any such actual relationship or order between the components.

A multi-wire LED rubber-covered string light includes a plurality of wires 1, and the wires 1 are disposed side by side. Each of the wires 1 includes a wire core 10 and an insulating layer 11 wrapping the wire core 10. The insulation layers 11 are removed in an axial direction of the wires 1 at fixed length intervals to form a plurality of solder joints 12. The solder joints 12 of the wires 1 are in one-to-one correspondence and form bead soldering areas 13. Patch LED beads 2 are disposed in the bead soldering areas 13. The patch LED beads 2 are connected to the bead soldering areas 13 in parallel, or in series, or in series and parallel. The patch LED beads 2 are fixed by dispensing after being connected to the bead soldering areas 13. Beads are formed by connecting the patch LED beads 2 with the bead soldering areas 13. The insulation layers 11 are removed in the axial direction of the wires 1 at fixed length intervals to form the plurality of solder joints 12, the solder joints 12 of the wires 1 are in one-to-one correspondence and form the bead soldering areas 13, the patch LED beads 2 are disposed in the bead soldering areas 13, the patch LED beads 2 are connected to the bead soldering areas 13 in parallel, or in series, or in series and parallel, the patch LED beads 2 are fixed by dispensing after being connected to the bead soldering areas 13, and the beads are formed by connecting the patch LED beads 2 with the bead soldering areas 13. In this way, the insulating layers 11 of the wires 1 are removed, the solder joints 12 of the wires are in one-to-one correspondence to form the soldering areas, the beads are wrapped by dispensing after being soldered, dispensing seats 3 are provided to enhance axial multi-point fixation of the wires 1 and reduce axial movement of the wires 1, and thus the overall dispensing firmness is improved.

The present disclosure is further set as: the bead soldering areas 13 further include the dispensing seats 3 disposed on the solder joints 12, each of the dispensing seats 3 includes a base 30, wire fixing slots 31 provided in the base 30, and wrapping seats 32 disposed on two axial sides of the base 30, the wire fixing slots 31 match the solder joints 12, and the wrapping seats 32 match the insulating layer 11. Further, due to the facts that each of the dispensing seats 3 includes the base 30, the wire fixing slots 31 provided in the base 30, and the wrapping seats 32 disposed on the two axial sides of the base 30, the wire fixing slots 31 match the solder joints 12, and the wrapping seats 32 match the insulating layer 11, an effect of dual fixation for non-exposed parts of the wires 1 and exposed parts of the wires 1 is achieved, the stability is high, double guarantee for tensile stability after dispensing for fixing is achieved, the structure is simple, and practicability is high.

The present disclosure is further set as: an inner wall on one axial side of the wire fixing slot 31 is provided with an inner tip structure 310, an inner wall on the other axial side of the wire fixing slot is set as an arc structure 311, and endpoints of two axial sides of the arc structure form two outer tip structures 312 on the inner wall on the other side of the wire fixing slot. Further, due to the facts that the inner wall on one axial side of the wire fixing slot 31 is provided with the inner tip structure 310, the inner wall on the other axial side of the wire fixing slot is set as the arc structure 311, and the endpoints of the two axial sides of the arc structure form the two outer tip structures 312 on the inner wall on the other side of the wire fixing slot, fitting of the wires 1 can be achieved through the arc structures, increasing the contact area between the wires 1 and the wire fixing slots; and the inner tip structures 310 and the outer tip structures 312 form a triangular fixing effect, such that the tensile effect of the wires 1 in the wire fixing slots is improved, the overall stability is greatly improved, the practicability is high, and the structure is simple.

The present disclosure is further set as: the arc structure is a concave arc. Due to the fact that the arc structure is a concave arc, the contact area between the exposed parts of the wires 1 and the arc structure is increased, the overall fitting effect is good, the stability is high, and the structure is simple.

The present disclosure is further set as: the base 30 is made of conductive material, the wrapping seats 32 are made of insulating material, the base 30 forms a totally wrapping structure with the patch LED beads 2 by dispensing, and the wrapping seats 32 are exposed outside a dispensing area. In this way, the exposed parts of the wires 1 and the parts, with the insulating layers 11, of the wires 1 are fixed through the base 30 and the wrapping seats 32 respectively, the stability after dispensing is improved, passing of limited material is further ensured, and the smoothness of conductivity is ensured accordingly.

The present disclosure is further set as: spiral positioning structures 33 are further disposed on the two axial sides of the base 30, the spiral positioning structures 33 include extension grooves 330 that are disposed on the base 30 and are perpendicular to the base 30, and spiral grooves 331 provided in inner walls of the extension grooves 330, and the exposed parts of the wires 1 are embedded in the spiral grooves 331 after passing through the two outer tip structures 312 of the inner wall on the other side of the wire fixing slot. Due to the facts that the spiral positioning structures 33 are further disposed on the two axial sides of the base 30, the spiral positioning structures 33 include the extension grooves 330 that are disposed on the base 30 and are perpendicular to the base 30, and the spiral grooves 331 provided in the inner walls of the extension grooves 330, and the exposed parts of the wires 1 are embedded in the spiral grooves 331 after passing through the two outer tip structures 312 of the inner wall on the other side of the wire fixing slot, the contact area between the parts of the wires 1 and the spiral grooves 331 is greatly increased by embedding the parts of the wires 1 along the spiral grooves 331, good structural stability is formed, the practicability is high, and the structure is simple.

The present disclosure is further set as: an embedding depth of the exposed parts of the wires 1 in the spiral grooves 331 is P, a diameter of the exposed parts of the wires 1 is R, and a ratio of P to R is 0.5-2. In this way, through the matched structure of the wires 1 and the spiral grooves 331, the wires 1 can be fully contained in the spiral grooves, the overall structural tensile strength is improved while stability is ensured, the stability and practicability are high, and the overall bonding area and strength are greatly improved.

The present disclosure is further set as: the wrapping seat 32 includes a seat body 320, wrapping walls 321 disposed at opposite positions on two radial sides of the seat body 320, and guide-in blocks 322 disposed on the wrapping walls 321, and forms a groove structure, sections of the guide-in blocks 322 are in an arc shape, and an arc height of the guide-in blocks 322 is increased gradually in a direction from a groove opening to a groove bottom. In this way, the wires 1 are convenient to install by providing the guide-in blocks 322, installation resistance of the wires 1 is also increased as the arc thickness of the guide-in blocks 322 is gradually increased, accordingly, it is more difficult for the wires 1 to disengage from the wrapping seats 32, the overall connection stability is greatly improved, and the practicability is high.

The present disclosure is further set as: a ratio of a thickness of ends, close to the groove bottom, of the guide-in blocks 322 to a thickness of ends, close to the groove opening, of the guide-in blocks is 0.5-2. Through the above thickness ratio of the guide-in blocks 322, the fixing effect of the wires 1 can be improved while it is ensured that the wires 1 are easy to install, the practicability is high, and the structure is simple.

A processing method applicable to the above multi-wire LED rubber-covered string light includes the following steps: S1. A preparation stage: wires 1, a wire stripping machine, beads, a soldering machine, dispensing seats 3, and a dispensing machine are prepared.

S2. A stripping stage: the wires 1 are stripped at a fixed length through the wire stripping machine.

S3. An installation stage: the stripped wires 1 are installed to the dispensing seats 3, and exposed parts of the wires 1 form a triangular fixed structure in wire fixing slots.

S4. A spiral fixing stage: parts, not fixed in the wire fixing slots, of the wires 1 are embedded into spiral grooves 331 to form spiral positioning.

S5. A dispensing stage: dispensing is performed on the wire fixing slots and the spiral grooves 331 through the dispensing machine, and temperature control is performed, so as to form dispensing wrapping. Dispensing wrapping specifically includes the following steps:

S50. Metal parts of the dispensing seats 3 are heated, a heating temperature being 70-80° C.

S51. A gas mixture is supplied to a dispensing area. The gas mixture is a mixture of nitrogen and oxygen, and contains 10-30% of oxygen by volume. A flow rate K (V/min) of the gas mixture satisfies $30-P \leq K < 40$ in the case that oxygen concentration in the gas mixture is specified as P (% by volume), and $P \geq 10$.

S6. A re-fixing stage: parts, on one sides of insulating layers 11, of the wires 1 are fixed onto wrapping seats 32 after the completion of dispensing, so as to complete processing.

The above technical solution has the following beneficial effects: in the method, by adding the process of heating the dispensing seats 3 in the dispensing process, the fluidity of glue is improved by preheating, the wrapping effect of the glue is ensured, the practicability is high, and the structure is simple; and by supplying the gas mixture which includes inert gas and oxygen, the dispensing environment can conform to the fluidity of the glue, the fully wrapping effect of the glue is achieved, the overall tensile effect is improved accordingly, the practicability is high, and the structure is simple.

The above are only preferred embodiments of the present disclosure and are not intended to limit the present disclosure. Usual changes and substitutions made by the technical personnel in the art within the scope of the technical solution of the present disclosure shall fall within the scope of protection of the present disclosure.

What is claimed is:

1. A multi-Wire LED rubber-covered string light, comprising a plurality of wires 1, the wires 1 being disposed side by side, each of the wires 1 comprising a wire core 10 and an insulating layer 11 wrapping the wire core 10, wherein the insulation layers 11 are removed in an axial direction of the wires 1 at fixed length intervals to form a plurality of solder joints 12, the solder joints 12 of the wires 1 are in one-to-one correspondence and form bead soldering areas 13, patch LED beads 2 are disposed in the bead soldering areas 13, the patch LED beads 2 are connected to the bead soldering areas 13 in parallel, or in series, or in series and parallel, the patch LED beads 2 are fixed by dispensing after being connected to the bead soldering areas 13, beads are formed by connecting the patch LED beads 2 with the bead soldering areas 13, the bead soldering areas 13 further comprise dispensing seats 3, the dispensing seats comprise a base 30, wire fixing slots 31 disposed in the base 30, and wrapping seats 32 disposed on two axial sides of the base 30, the wire fixing slots 31 match the solder joints 12, and the wrapping seats 32 match the insulating layers 11, the dispensing seats 3 are provided to enhance axial multi-point fixation of the wires 1 and reduce axial movement of the wires 1.

2. The multi-Wire LED rubber-covered string light according to claim 1, wherein an inner wall on one axial side of the wire fixing slot 31 is provided with an inner tip structure 310, an inner wall on the other axial side of the wire fixing slot 31 is set as an arc structure 311, and endpoints of two axial sides of the arc structure 311 form two outer tip structures 312 on the inner wall on the other side of the wire fixing slot 31.

3. The multi-Wire LED rubber-covered string light according to claim 1, wherein the arc structure 311 is a concave arc.

4. The multi-Wire LED rubber-covered string light according to claim 1, wherein the base 30 is made of conductive material, the wrapping seats 32 are made of insulating material, the base 30 forms a totally wrapping structure with the patch LED beads 2 by dispensing, and the wrapping seats 32 are exposed outside a dispensing area.

5. The multi-Wire LED rubber-covered string light according to claim 2, wherein spiral positioning structures 33 are further disposed on the two axial sides of the base 30, the spiral positioning structures 33 comprise extension grooves 330 that are disposed on the base 30 and are perpendicular to the base 30, and spiral grooves 331 provided in inner walls of the extension grooves 330, and exposed parts of the wires 1 are embedded in the spiral grooves 331 after passing through the two outer tip structures 312 of the inner wall on the other side of the wire fixing slot 31.

6. The multi-Wire LED rubber-covered string light according to claim 5, wherein an embedding depth of the exposed parts of the wires 1 in the spiral grooves 331 is P, a diameter of the exposed parts of the wires 1 is R, and a ratio of P to R is 0.5-2.

7. The multi-Wire LED rubber-covered string light according to claim 1, wherein the wrapping seat 32 comprises a seat body 320, wrapping walls 321 disposed at opposite positions on two radial sides of the seat body 320, and guide-in blocks 322 disposed on the wrapping walls 321, and forms a groove structure, sections of the guide-in blocks 322 are in an arc shape, and an arc height of the guide-in blocks 322 is increased gradually in a direction from a groove opening to a groove bottom.

8. The multi-Wire LED rubber-covered string light according to claim 7, wherein a ratio of a thickness of ends, close to the groove bottom, of the guide-in blocks 322 to a thickness of ends, close to the groove opening, of the guide-in blocks 322 is 0.5-2.

9. A processing method applicable to the multi-Wire LED rubber-covered string light according to any one of claim 1, comprising the following steps:

S1, a stripping stage: stripping the wires 1 at a fixed length through the wire stripping machine;

S2, an installation stage: installing the stripped wires 1 to the dispensing seats 3, exposed parts of the wires 1 forming a triangular fixed structure in wire fixing slots 31;

S3, a spiral fixing stage: embedding parts, not fixed in the wire fixing slots 31, of the wires 1 into spiral grooves 331 to form spiral positioning;

S4, a dispensing stage: performing dispensing on the wire fixing slots 31 and the spiral grooves 331 through the dispensing machine, and performing temperature control, wherein the insulating layers of the wires are removed, the solder joints of the wires are in one-to-one correspondence to form the soldering areas, the beads are wrapped by dispensing after being soldered via a soldering machine, so as to form dispensing wrapping, dispensing wrapping specifically comprising the following steps:

S5, heating metal parts of the dispensing seats 3, a heating temperature being 70-80° C.; and S6, supplying a gas mixture to a dispensing area, the gas mixture being a mixture of nitrogen and oxygen, and containing 10-30% of oxygen by volume, a flow rate K (V/min) of the gas mixture satisfying $30-P \leq K < 40$ in the case that oxygen concentration in the gas mixture is specified as P (% by volume), $P \geq 10$; and S7, a re-fixing stage: fixing parts, on one sides of insulating layers 11, of the wires 1 onto wrapping seats 32 after the completion of dispensing, so as to complete processing.

* * * * *